US008353302B2

(12) United States Patent
Olegario et al.

(10) Patent No.: US 8,353,302 B2
(45) Date of Patent: Jan. 15, 2013

(54) SMOKING ARTICLES WITH RESTRICTOR AND AEROSOL FORMER

(75) Inventors: Raquel Olegario, Richmond, VA (US); San Li, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 1072 days.

(21) Appl. No.: 12/073,649

(22) Filed: Mar. 7, 2008

(65) Prior Publication Data

US 2008/0216851 A1 Sep. 11, 2008

Related U.S. Application Data

(60) Provisional application No. 60/905,835, filed on Mar. 9, 2007.

(51) Int. Cl.
*A24D 3/04* (2006.01)

(52) U.S. Cl. ..... 131/339; 131/202

(58) Field of Classification Search ..... 131/342, 131/341, 202, 339, 338
See application file for complete search history.

(56) References Cited

U.S. PATENT DOCUMENTS

| | | | |
|---|---|---|---|
| 2,511,898 | A | 6/1950 | Brothers |
| 2,547,119 | A | 4/1951 | Henderson |
| 2,592,553 | A | 4/1952 | Frankenburg et al. |
| 2,592,554 | A | 4/1952 | Frankenburg |
| 2,598,680 | A | 6/1952 | Frankenburg |
| 2,764,513 | A | 9/1956 | Brothers |
| 2,769,734 | A | 11/1956 | Bandel |
| 2,954,772 | A | 10/1960 | Lebert |
| 2,954,778 | A | 10/1960 | Lebert |
| 2,954,783 | A | 10/1960 | Lebert |
| 2,954,786 | A | 10/1960 | Lebert |
| 3,098,492 | A | 7/1963 | Wurzburg et al. |
| 3,234,949 | A | 2/1966 | White et al. |
| 3,236,244 | A | 2/1966 | Irby, Jr. et al. |

(Continued)

FOREIGN PATENT DOCUMENTS

BE 679657 A 10/1966

(Continued)

OTHER PUBLICATIONS

Written Opinion dated Aug. 5, 2004 for International Application No. PCT/US04/04530.

(Continued)

*Primary Examiner* — Richard Crispino
*Assistant Examiner* — Dionne Walls Mayes
(74) *Attorney, Agent, or Firm* — Buchanan Ingersoll & Rooney PC

(57) ABSTRACT

Provided is a smoking article including a smokeable filler with a high aerosol former content and a filter. Preferably, the smokeable filler includes about 4 wt % glycerin to about 35 wt % glycerin. The filter includes a cylindrical tube attached to the tobacco rod with tipping paper, a first filter segment at a location along said cylindrical tube adjacent and in a downstream relation to said tobacco rod, and a flow restricting filter segment at a location adjacent and in a downstream relation to the first filter segment. In an embodiment, the filter also includes a cavity adjacent and in a downstream relation to the flow restricting filter segment, and a ventilation zone at a location along the cavity including perforations that extend through the tipping paper and the cylindrical tube. Preferably, the ventilation zone is in a downstream relation to the flow restricting filter segment.

13 Claims, 10 Drawing Sheets

U.S. PATENT DOCUMENTS 3,255,760 A 6/1966 Selke
3,283,762 A 11/1966 Kissel
3,292,635 A 12/1966 Kolodny
3,318,312 A 5/1967 Curtis, Jr.
3,323,525 A 6/1967 Miller
3,356,094 A 12/1967 Ellis et al.
3,389,705 A 6/1968 Levavi
3,395,713 A 8/1968 Ent-Keller
3,441,028 A 4/1969 Wall
3,457,927 A 7/1969 Siragusa
3,496,945 A * 2/1970 Tomkin ..... 131/336
3,504,677 A 4/1970 Doppelt
3,581,748 A * 6/1971 Cameron ..... 131/336
3,599,646 A 8/1971 Berger et al.
3,630,210 A 12/1971 Haslam
3,637,447 A 1/1972 Berger et al.
3,646,941 A 3/1972 Doppelt
3,648,712 A 3/1972 Patterson
3,685,522 A 8/1972 Kleinhans
3,738,375 A 6/1973 Doumas
3,756,249 A 9/1973 Selke et al.
3,759,270 A 9/1973 Wright
3,860,011 A 1/1975 Norman
3,877,470 A 4/1975 Jewett et al.
3,931,824 A 1/1976 Miano et al.
3,968,804 A 7/1976 Kelly et al.
3,986,515 A 10/1976 Egri
4,016,887 A 4/1977 Uroshevich
4,022,222 A 5/1977 Berger
4,038,994 A 8/1977 Aikman
4,091,821 A 5/1978 Scorzo
4,119,105 A 10/1978 Owens, Jr.
4,120,310 A 10/1978 Lee et al.
4,135,523 A 1/1979 Luke et al.
4,158,364 A 6/1979 Ligeti
4,182,349 A 1/1980 Selke
4,186,756 A 2/1980 Takemoto et al.
4,197,863 A 4/1980 Clayton et al.
4,256,122 A 3/1981 Johnson
4,256,126 A 3/1981 Seligman et al.
4,273,141 A 6/1981 Jan Van Tilburg
4,292,983 A 10/1981 Mensik
4,340,072 A 7/1982 Bolt et al.
4,341,228 A 7/1982 Keritsis et al.
4,343,319 A 8/1982 Cantrell
4,357,950 A 11/1982 Berger
4,380,241 A 4/1983 Horsewell
4,386,618 A 6/1983 Cantrell
4,421,126 A 12/1983 Gellatly
4,460,001 A 7/1984 Browne et al.
4,469,112 A 9/1984 Browne et al.
4,506,683 A 3/1985 Cantrell et al.
4,508,525 A 4/1985 Berger
4,515,170 A 5/1985 Cantrell et al.
4,542,755 A 9/1985 Selke et al.
4,559,955 A 12/1985 Brockway et al.
4,564,030 A 1/1986 Jessup et al.
4,574,820 A 3/1986 Pinkerton et al.
4,617,946 A 10/1986 Keith
4,620,553 A 11/1986 Bale et al.
4,622,982 A 11/1986 Gaisch et al.
4,637,409 A 1/1987 Berger
4,646,762 A 3/1987 Riehl et al.
4,649,944 A 3/1987 Houck, Jr. et al.
4,660,579 A 4/1987 Horsewell et al.
4,677,992 A 7/1987 Bliznak
4,687,008 A 8/1987 Houck, Jr. et al.
4,700,726 A 10/1987 Townsend et al.
4,702,263 A 10/1987 Strydom
4,732,168 A 3/1988 Resce et al.
4,754,766 A 7/1988 Luke et al.
4,784,632 A 11/1988 Berger
4,791,943 A 12/1988 Kupper et al.
4,793,365 A 12/1988 Sensabaugh et al.
4,809,717 A * 3/1989 Imbery et al. ..... 131/332
4,867,182 A 9/1989 Roberts et al.
4,896,682 A 1/1990 Liew
4,924,886 A 5/1990 Litzinger
4,942,887 A 7/1990 Abdelgawad et al.
4,949,736 A 8/1990 Roberts et al.
4,962,774 A 10/1990 Thomasson et al.
4,972,853 A 11/1990 Brackmann et al.
4,972,854 A 11/1990 Kiernan et al.
4,984,588 A 1/1991 Stewart, Jr.
5,046,514 A 9/1991 Bolt
5,050,621 A 9/1991 Creighton et al.
5,058,608 A 10/1991 Henning et al.
5,060,676 A 10/1991 Hearn et al.
5,074,319 A 12/1991 White et al.
5,099,864 A 3/1992 Young et al.
5,101,839 A 4/1992 Jakob et al.
5,105,836 A 4/1992 Gentry et al.
5,105,838 A 4/1992 White et al.
5,129,408 A 7/1992 Jakob et al.
5,152,304 A 10/1992 Bokelman et al.
5,178,166 A 1/1993 Newsome et al.
5,190,061 A 3/1993 Brackmann et al.
5,203,354 A 4/1993 Hickle
5,360,023 A 11/1994 Blakley et al.
5,392,792 A 2/1995 Banerjee et al.
5,392,793 A 2/1995 Molloy
5,435,326 A 7/1995 Gentry et al.
5,458,107 A 10/1995 Balogh et al.
5,524,647 A 6/1996 Brackmann
5,533,530 A 7/1996 Young et al.
5,568,819 A 10/1996 Gentry et al.
5,584,306 A 12/1996 Beauman et al.
5,598,868 A 2/1997 Jakob et al.
5,666,976 A 9/1997 Adams et al.
5,690,127 A 11/1997 Chapman et al.
5,709,227 A 1/1998 Arzonico et al.
5,715,844 A 2/1998 Young et al.
5,724,998 A 3/1998 Gellatly et al.
5,727,571 A 3/1998 Meiring et al.
5,743,251 A 4/1998 Howell et al.
5,746,230 A 5/1998 Arterbery et al.
5,839,449 A 11/1998 Banerjee et al.
5,954,061 A 9/1999 Cardarelli
5,979,459 A 11/1999 Schneider
6,062,228 A 5/2000 Loercks et al.
6,089,238 A 7/2000 Schneider et al.
6,216,706 B1 4/2001 Kumar et al.
6,257,242 B1 7/2001 Stavridis
6,502,580 B1 1/2003 Luparini
6,718,989 B1 4/2004 Clarke et al.
6,761,174 B2 7/2004 Jupe et al.
6,779,529 B2 8/2004 Figlar et al.
6,814,786 B1 11/2004 Zhuang et al.
6,823,873 B2 11/2004 Nichols et al.
6,883,516 B2 4/2005 Hindle et al.
6,883,523 B2 4/2005 Dante
2002/0166561 A1 11/2002 Sinclair, Jr.
2003/0200973 A1 10/2003 Xue et al.
2003/0200976 A1 10/2003 Yoo
2004/0025890 A1 2/2004 Yen
2004/0159327 A1 8/2004 Dante
2004/0261807 A1 12/2004 Dube et al.
2005/0066980 A1* 3/2005 Crooks et al. ..... 131/341
2005/0066981 A1 3/2005 Crooks et al.
2006/0011206 A1* 1/2006 Clarke ..... 131/338
2006/0086367 A1* 4/2006 Li et al. ..... 131/334
2006/0201524 A1 9/2006 Zhang et al.
2006/0225753 A1* 10/2006 Kaczmarek et al. ..... 131/334
2006/0283469 A1* 12/2006 Lipowicz ..... 131/352
2007/0169785 A1 7/2007 Gedevanishvili et al.
2007/0181140 A1 8/2007 Xue et al.
2007/0186945 A1 8/2007 Olegario et al.
2007/0235050 A1 10/2007 Li et al.
2007/0261706 A1 11/2007 Banerjea et al.
2008/0017204 A1 1/2008 Braunshteyn et al.
2008/0035162 A1 2/2008 Braunshteyn et al.
2008/0047571 A1 2/2008 Braunshteyn et al.
2008/0163877 A1 7/2008 Zhuang et al.
2008/0216848 A1 9/2008 Li et al.
2008/0216850 A1 9/2008 Li et al.
2008/0216853 A1 9/2008 Li et al.
2010/0288293 A1 11/2010 Slasli et al.

FOREIGN PATENT DOCUMENTS

| | | | |
|---|---|---|---|
| BE | 1000454 | A4 | 12/1988 |
| DE | 3439861 | A1 | 5/1985 |
| EP | 0 054 705 | A1 | 6/1982 |
| EP | 0077123 | A2 | 4/1983 |
| EP | 0101840 | A | 3/1984 |
| EP | 0212879 | A1 | 3/1987 |
| EP | 0 327 655 | A1 | 8/1989 |
| EP | 0364256 | A1 | 4/1990 |
| EP | 0471581 | A1 | 2/1992 |
| EP | 0482872 | A1 | 4/1992 |
| EP | 0568107 | A | 11/1993 |
| EP | 0481596 | B1 | 1/1994 |
| FR | 2873899 | A | 2/2006 |
| GB | 1058342 | A | 2/1967 |
| GB | 1228747 | | 4/1971 |
| GB | 1236344 | A | 6/1971 |
| GB | 1245518 | A | 9/1971 |
| GB | 1256154 | | 12/1971 |
| GB | 1428018 | | 3/1976 |
| GB | 2100573 | A | 1/1983 |
| GB | 2149287 | A | 6/1985 |
| GB | 2177890 | A | 2/1987 |
| NZ | 19697 | | 11/1983 |
| NZ | 216244 | | 9/1989 |
| WO | WO 90/09741 | A | 9/1990 |
| WO | WO 99/26495 | A | 6/1999 |
| WO | WO00/00047 | | 1/2000 |
| WO | WO 01/13745 | A1 | 3/2001 |
| WO | WO 02/03819 | A | 1/2002 |
| WO | WO 2006/070289 | A | 7/2006 |
| WO | WO 2006/082529 | A | 8/2006 |
| WO | WO2007/093757 | A1 | 8/2007 |
| WO | WO2007/110650 | A1 | 10/2007 |

OTHER PUBLICATIONS

International Search Report dated Aug. 5, 2004 for PCT/US04/04530.
International Search Report dated Oct. 19, 2007 for International Application No. PCT/IB2006/004202.
Written Opinion dated Oct. 19, 2007 for International Application No. PCT/IB2006/004202.
International Search Report and Written Opinion dated Mar. 17, 2008 for PCT/IB2006/004209.
International Preliminary Report on Patentability dated Jul. 10, 2008 for PCT/IB2006/004202.
International Preliminary Report on Patentability dated Jul. 10, 2008 for PCT/IB2006/004209.
International Search Report and Written Opinion dated Sep. 19, 2008 for PCT/IB2007/004503.
International Preliminary Report on Patentability mailed Jul. 9, 2009 for PCT/IB2007/004503.
International Preliminary Report on Patentability mailed Sep. 24, 2009 for International Application No. PCT/IB2008/001372.
International Preliminary Report on Patentability for PCT/IB2007/004224 dated May 19, 2009.
International Preliminary Report on Patentability for PCT/GB2007/001144 dated Sep. 30, 2008.
International Search Report and Written Opinion for PCT/IB2007/004224 dated Jun. 13, 2008.
International Search Report and Written Opinion for PCT/GB2007/00114 dated Jul. 11, 2007.
International Preliminary Report on Patentability mailed Sep. 15, 2009 for PCT/IB2008/001383.
International Search Report and Written Opinion mailed Feb. 24, 2009 for PCT/IB2008/001383.
Partial International Search Report mailed Nov. 11, 2008 for PCT/IB2008/001383.
International Preliminary Report on Patentability issued Jan. 13, 2009 for PCT/IB2007/002869.
International Search Report and Written Opinion dated Jan. 25, 2008 for PCT/IB2007/002869.
International Preliminary Report on Patentability issued Jan. 13, 2009 for PCT/IB2007/002910.
International Search Report and Written Opinion dated Jan. 24, 2008 for PCT/IB2007/002910.
International Search Report and Written Opinion mailed Jan. 27, 2009 for PCT/IB2008/001348.
International Preliminary Report on Patentability issued Sep. 15, 2009 for PCT/IB2008/001348.
New Zealand Examination Report cited in New Zealand Patent Application No. 573730, Jul. 8, 2010.
International Search Report and Written Opinion dated Oct. 7, 2008 for PCT/IB2008/001382.
International Preliminary Report on Patentability issued Sep. 15, 2009 for PCT/IB2008/001382.
International Preliminary Report on Patentability issued Feb. 10, 2009 for PCT/IB2007/003165.
New Zealand Examination Report cited in New Zealand Patent Application No. 571453, Mar. 10, 2010.
U.S. Appl. No. 12/576,922, filed Oct. 9, 2009.
U.S. Appl. No. 12/782,443, filed May 18, 2010.
International Search Report mailed Sep. 13, 2010 for International Application No. PCT/EP2010/003016.
International Search Report and Written Opinion dated Nov. 3, 2008 for PCT/IB2008/001372.

* cited by examiner

SMOKING ARTICLES WITH RESTRICTOR AND AEROSOL FORMER

CROSS REFERENCE TO RELATED APPLICATION

This application claims priority under 35 U.S.C. §119(e) to U.S. provisional Application No. 60/905,835, filed on Mar. 9, 2007, the entire content of which is incorporated herein by reference.

BACKGROUND

Heretofore, cigarettes with high levels of ventilation have usually had unacceptably low levels of resistance to draw (RTD) unless some counter measure was in place to make-up for the shortfall in RTD. In the past, high density cellulose acetate filter segments were used to address the shortfall. However such filtered segments tended to reduce tar delivery (FTC), with little or no effect upon gas phase components of mainstream tobacco smoke, such as carbon monoxide (CO) and nitrogen oxide (NO). This solution tended to worsen the CO to tar (FTC) ratios in lower delivery (FTC tar) cigarettes.

Ventilation has a desirable attribute in that, when operating alone, it will reduce both the particulate phase and the gas phase of mainstream smoke. Highly ventilated cigarettes however have drawbacks in RTD as previously discussed.

DETAILED DESCRIPTION

During a puff on a smoking article incorporating a restrictor in the filter and an aerosol former such as glycerin in the tobacco rod, such glycerin vaporizes, introducing glycerin and water into the mainstream tobacco smoke and diluting particulate phase constituents present in the smoke. The particulate phase includes phenolics, such as catechol, hydroquinone, phenol and tobacco-specific nitrosamines (TSNA). For a given level of FTC tar delivery, any glycerin, being part of the particulate phase, will, in effect, displace other particulate phase constituents that would have otherwise originated from the combustion of tobacco during a puff. Some aerosol formers, such as glycerin, act as a tar diluent and if present in sufficient quantity may also act as a phenol control agent to further reduce phenol levels in mainstream smoke beyond the levels attributable solely to dilution.

Smoke constituents can also be reduced with ventilated filters. Ventilation has a desirable attribute in that, when operating alone, it will reduce both the particulate phase and the gas phase of mainstream smoke.

However, cigarettes with high levels of ventilation have usually had unacceptably low levels of resistance to draw (RTD) unless some counter measure is in place. One solution to this problem with RTD was to include high density cellulose acetate filter segments. However, such high density filter segments tended to reduce tar delivery (FTC), with little or no effect upon gas phase constituents of mainstream tobacco smoke, such as carbon monoxide (CO) and nitrogen oxide (NO). This solution tends to worsen the CO to tar (FTC) ratios especially in lower delivery (FTC tar) cigarettes.

On the other hand, cellulose acetate filter segments comprising cellulose acetate tow and triacetin plasticizer are known to be effective in removing phenols and cresols from mainstream cigarette smoke. Any substantial reduction in the mass or density of such filter segments has tended to create higher proportional constituency levels in mainstream smoke of phenols and cresols on a per unit tar (FTC) basis.

Thus, there is a need in the art for a smoking article having a highly ventilated filter with an acceptable RTD and with both an improved CO to FTC tar ratio and reductions in phenols and cresols.

Figure 1A:
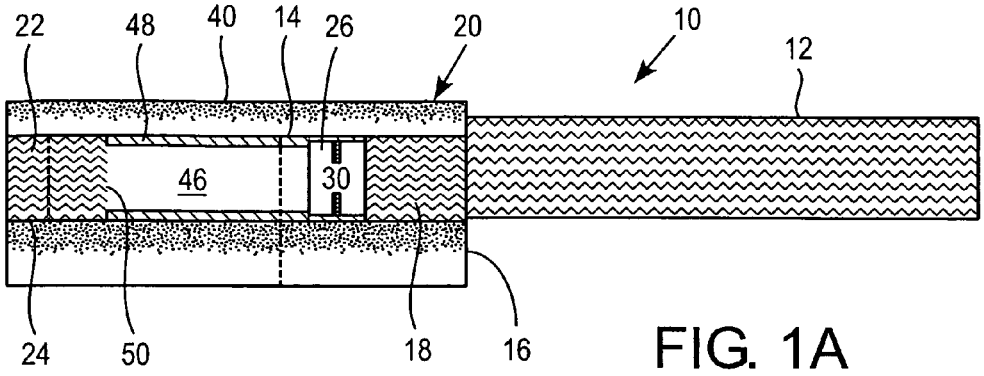
FIG. 1A is a side view of a smoking article constructed in accordance with a preferred embodiment, wherein the filter tipping paper has been partially unfolded to reveal internal filter components.

Referring to FIG. 1A, a preferred embodiment provides a smoking article 10 comprising a tobacco rod 12, including cut filler having a high glycerin content, and a filter 14 connected with the tobacco rod 12 by a tipping paper 16. In a preferred embodiment, the glycerin content in the tobacco rod 12 of the smoking article is about 4 wt % to about 35 wt % glycerin, more preferably, 5 wt % to 10 wt % glycerin, and most preferably, 5 wt % to 8 wt % glycerin.

Figure 1B:
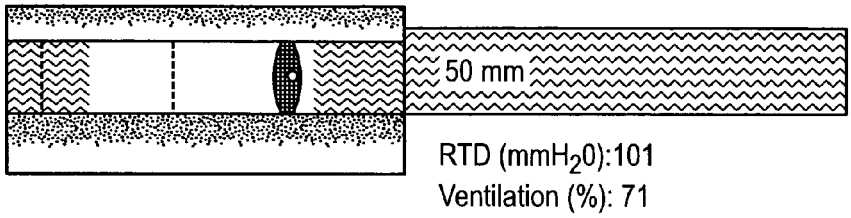
FIGS. 1B-1D are representations of experimentally measured values of RTD and ventilation of an unlit smoking article constructed with downstream ventilation.
Figure 1C:
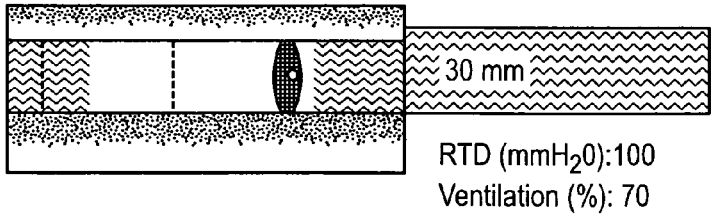
Figure 1D:
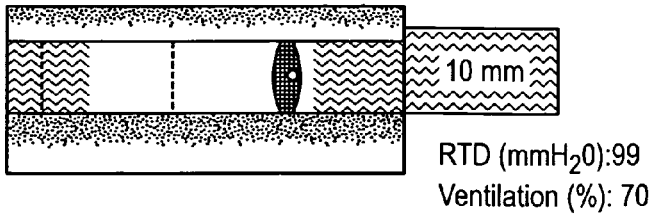

Referring now to FIGS. 1B-1D and Table 1 below, for unlit cigarettes having downstream ventilation and an upstream restriction, a desired degree of ventilation (approximately 70%) is maintained throughout the puff count.

Figure 1E:
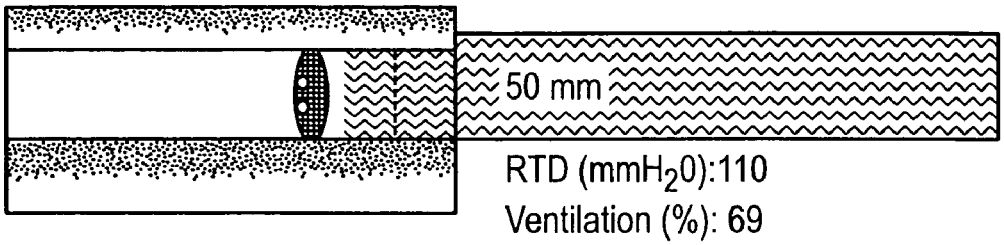
FIGS. 1E-1G are representations of experimentally measured values of RTD and ventilation of an unlit smoking article constructed with upstream ventilation.
Figure 1F:
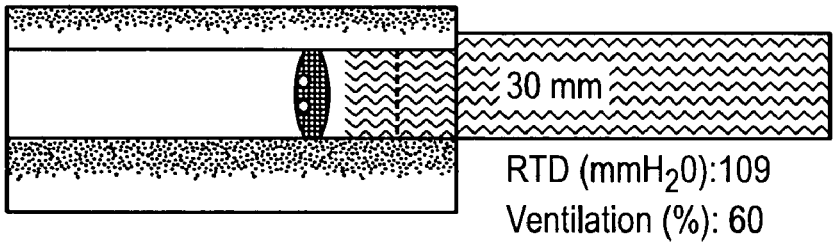
Figure 1G:
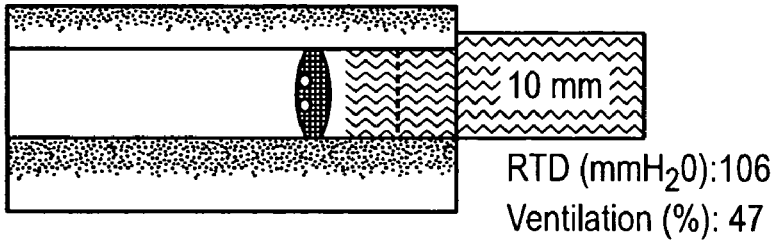

Referring now to FIGS. 1E-1G, in contrast, when ventilation holes are placed upstream of the restriction, ventilation tended to drop as one progresses through the puff count.

TABLE 1

| Remainder of Tobacco Rod | Restrictor Upstream of Ventilation | Restrictor Downstream of Ventilation |
|---|---|---|
| 50 mm | RTD (mm $H_2O$): 101<br>Ventilation (%): 71 | RTD (mm $H_2O$): 110<br>Ventilation (%): 69 |
| 30 mm | RTD (mm $H_2O$): 100<br>Ventilation (%): 70 | RTD (mm $H_2O$): 109<br>Ventilation (%): 60 |
| 10 mm | RTD (mm $H_2O$): 99<br>Ventilation (%): 70 | RTD (mm $H_2O$): 106<br>Ventilation (%): 47 |

In an embodiment, the cut filler includes a reconstituted tobacco sheet having a high glycerin content. Preferably, about 10% to about 80% of the smokeable material (cut filler) in the tobacco rod 12 is of reconstituted tobacco sheet. More preferably, the tobacco rod includes about 30% to about 50% of the reconstituted tobacco sheet, and more preferably about 35% to about 45%. However, in other embodiments, the cut filler does not include a reconstituted tobacco sheet, but includes enhanced glycerin levels applied to the cut filler.

The reconstituted tobacco sheet is cut into smokeable filler material for a smoking article. Preferably, the reconstituted tobacco sheet includes up to about 50% w/w of glycerin. In an embodiment, additional cut tobacco filler material is also incorporated into the tobacco rod 12.

Figure 2:
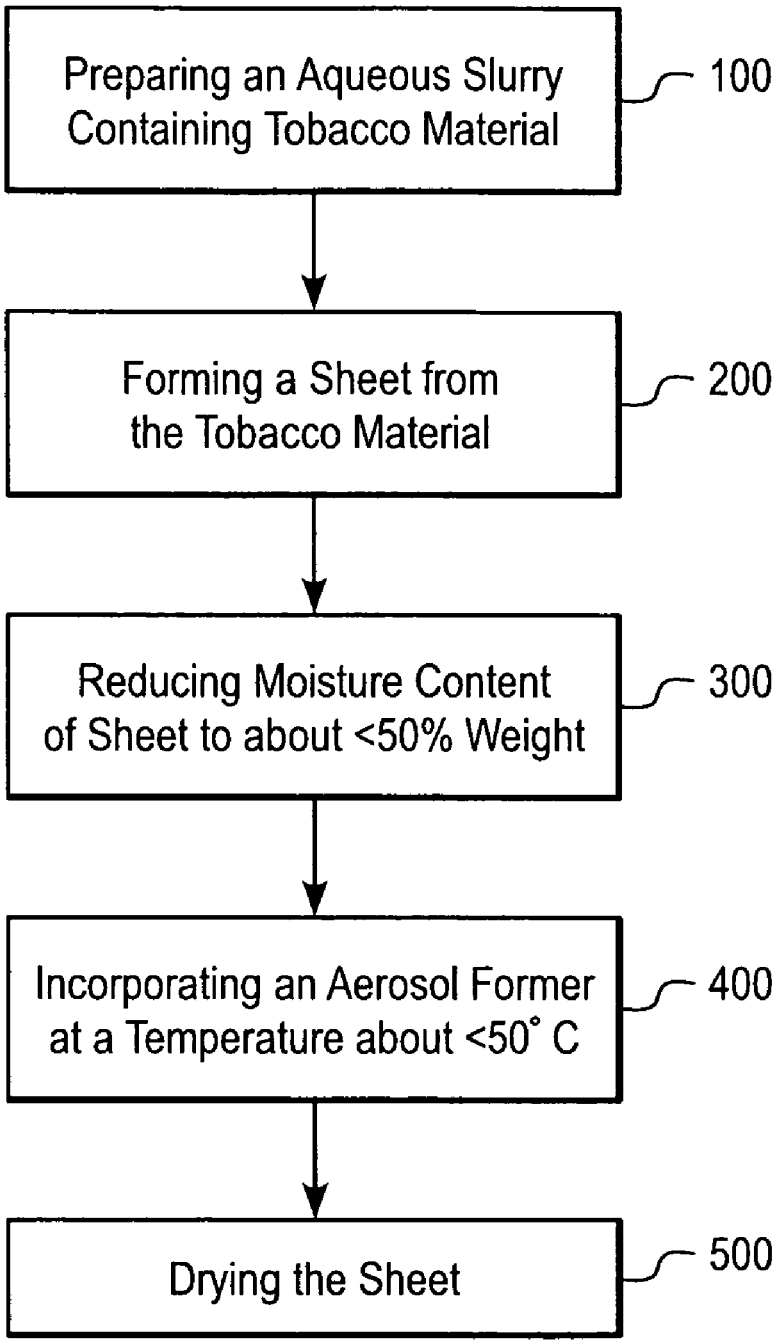
FIG. 2 is a diagram illustrating an exemplary embodiment of a method of making a reconstituted tobacco sheet having a high glycerin content.

FIG. 2 shows an exemplary embodiment of a method of making a reconstituted tobacco sheet having a high glycerin content for inclusion in smoking articles. In step 100, an aqueous slurry containing tobacco materials is prepared. In the next step 200, a tobacco sheet is formed from the aqueous slurry. The moisture content of the aqueous slurry is reduced to under 50% by weight in step 300. After reducing the moisture content of the tobacco sheet, an aerosol former is incorporated into the tobacco sheet at a temperature of preferably less than about 40° C. Next, in step 500, the tobacco sheet undergoes a drying process.

Figure 3:
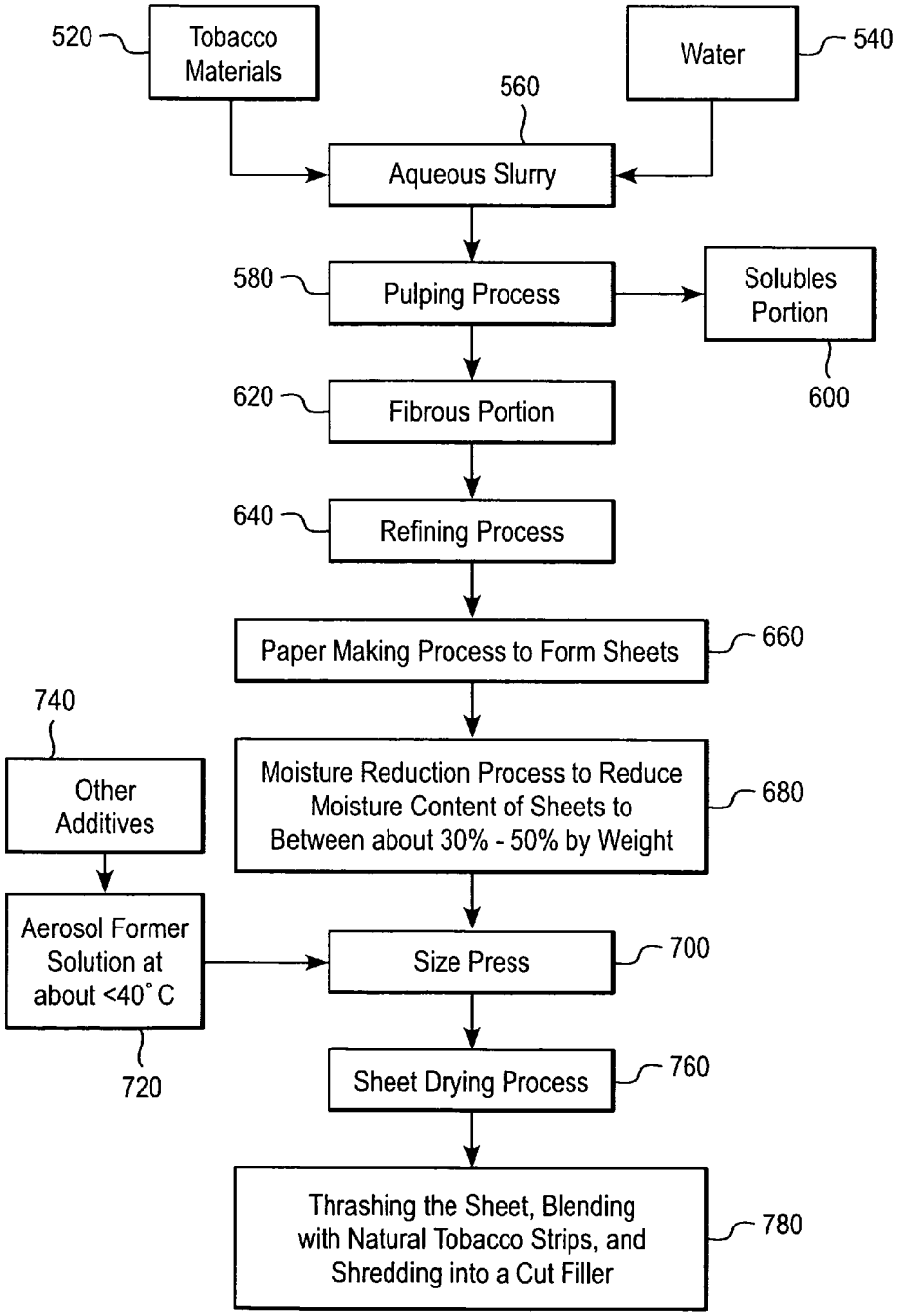
FIG. 3 is a diagram illustrating a preferred embodiment of a method of making a reconstituted tobacco sheet having a high glycerin content.

FIG. 3 shows a preferred embodiment of the method of making a reconstituted tobacco sheet. In a first step, tobacco materials 520 and water 540 are mixed to form an aqueous slurry 560. The tobacco materials 520 can be tobacco leaf scraps and/or tobacco dust created during tobacco processing and/or cigarette manufacturing. For example, the tobacco material 520 can contain at least about 50% by weight stems, preferably about 70% to about 80% by weight stems, with the balance containing tobacco leaf scraps and/or tobacco dust.

The aqueous slurry 560 is subjected to a separation process 580 to produce a solubles portion 600 and a fibrous portion 620. For example, aqueous slurry 560 can be compressed or centrifuged to remove the solubles portion 600. Preferably, the solubles portion 600 is not reincorporated into the reconstituted tobacco manufacturing process, but discarded.

As shown in FIG. 2, in the embodiment, the fibrous portion 620 is subjected to a refining process 640 to convert the fibrous portion 620 to more closely approximate individual fibers for paper-making. The fibrous portion 620 is formed into tobacco sheets by a paper-making process 660 (e.g., Fourdrinier machine). During this paper-making process 660, the moisture content of the sheet is reduced by draining excess water through a wire mesh (e.g., Fourdrinier wire). For example, the moisture content can be reduced from a starting moisture content of about 98-99% by weight to about 95% by weight by pure draining. In another example, the moisture content can be reduced to about 85% if draining is coupled with vacuuming of moisture.

After the paper-making process 660 has been completed, the tobacco sheets are subjected to a moisture reduction process 680 to reduce the moisture content of the sheet. Preferably, the moisture content is reduced to less than 50% by weight, but greater than 30% by weight. In other exemplary embodiments, the moisture content is reduced to less than 45% by weight, less than 40% by weight, or less than 35% by weight. For example, the sheets can be placed on a steam-heated metal drum (i.e., Yankee dryer) to reduce the moisture content and optionally followed by smaller steam-heated surface dryers (i.e. can dryers).

After the moisture reduction process 680, an aerosol former solution 720 is applied to the sheet. For example, the sheets can be passed through a size press 700, in which the sheets are fed between two vertical or horizontal rollers, configured to apply an aerosol former solution 720 to both sides of the sheet. The aerosol former solution 720 can include other additives 740. In alternative embodiments, the aerosol former solution 720 can be sprayed onto the sheet, or the sheet can be immersed in the aerosol former solution 720.

Examples of aerosol formers include glycerin, propylene glycol, ethylene glycol, dipropylene glycol, diethylene glycol, triethylene glycol, tetraethylene glycol, and/or oleyl alcohol.

In one embodiment, an aerosol former solution 720 is incorporated into the sheet at a temperature below about 40° C. In other exemplary embodiments, the aerosol former solution 720 is incorporated into the sheet at temperatures below about 35° C., e.g., below about 30° C. or 25° C., or at ambient temperature.

Glycerin is a preferred aerosol former for aerosol former solution 720. Glycerin forms an inert aerosol of glycerin and water vapor when present in a combusting tobacco rod of a smoking article. For example, the glycerin aerosol former can be incorporated into the sheet as an aqueous glycerin solution containing about 20% to 80% glycerin by volume. In alternative embodiments, the glycerin solution can contain about 50 to 80% glycerin by volume. Preferably, the aqueous glycerin solution contains between about 75% to about 80% by volume glycerin. Attempts to use a solution of about 100% glycerin results in poor absorption of the glycerin into the tobacco material, resulting in a tacky surface, which can present difficulties in the manufacturing process.

The aerosol former solution 720 can also contain other additives 740, such as flavorants, humectants (other than glycerin), and/or acetate compounds. Examples of flavorants include licorice, sugar, isosweet, cocoa, lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, ylang-ylang, sage, spearmint, ginger, coriander, coffee and the like. Examples of humectants other than glycerin include propylene glycol and the like.

Tobacco materials with a higher concentration of glycerin may also contain optional additives. Acetates have been identified as possibly promoting reduction in TPM cytotoxicity of tobacco smoke, especially in combination with glycerin. Acetate compounds may further enhance the reduction of TPM or phenolics in the smoke of a combusted smoking article. In one embodiment, the acetate compound includes ammonium acetate, calcium acetate, and/or magnesium acetate. The one or more acetate compounds are added in an amount effective to promote the reduction of catechol, hydroquinone, phenol, or TSNA in the smoke of a combusted smoking article incorporating the sheet as a cut filler.

As shown in FIG. 3, after passing the sheet through the size press 700, in which the aerosol former solution 720 is incorporated, the sheet is exposed to a drying process 760. For example, the drying process 760 can include passing the sheet through a tunnel or apron dryer.

In one embodiment in which the aerosol former solution 720 is glycerin, the glycerin solution is added in an amount effective to produce a non-tacky sheet upon drying. In another embodiment, the glycerin solution is added in an amount up to about 50% by weight of the tobacco sheet after drying.

Ammonium acetate can be incorporated into the tobacco sheet preferably in an amount between about 5% to about 20% by weight of the sheet after drying, or more preferably about 10% to about 12%. In lieu of or in addition to ammonium acetate, calcium acetate can be incorporated in an amount preferably between about 1% to about 10% by weight of the sheet after drying, and more preferably about 4%. In lieu of or in addition to ammonium acetate and/or calcium acetate, magnesium acetate can be incorporated in an amount preferably between about 5% to about 20% by weight of the sheet after drying, and more preferably about 8% to about 10%.

After the drying process 760, the sheet containing an aerosol former (e.g., glycerin, propylene glycol, manitol, sorbitol) can be shredded into a cut filler and incorporated into a smoking article. The overall reduction in the tobacco originated TMP is proportional to the amount of glycerin incorporated in a smoking article as part of the cut filler.

As seen in FIG. 1A, the filter 14 of the smoking article 10 preferably comprises a first upstream filter segment (restrictor) 18 at an upstream portion 20 of the filter 14, a mouthpiece filter segment 22 at downstream end portion 24 of the filter 14, and a flow restricting filter segment 26 situated between the first and mouthpiece filter segments 18 and 22. In this embodiment, filter segments 18 and 22 are low particulate efficiency filter segments preferably constructed from less densely packed, large diameter fiber cellulose acetate tow of about 5.0 denier per filament to approximately 15.0 denier per filament (dpf), such as 8 dpf, and approximately 10,000 total denier to approximately 50,000 total denier (td), such as 35,000 td. More preferably, the filter segments include cellulose acetate tow of approximately 6.0 denier to approximately 15.0 denier per filament. This embodiment also includes a relatively short flow restricting filter segment 26 (hereinafter, restrictor disc 26) adjacent the first upstream filter segment 18 and has a length of approximately 3 to 10 mm, more preferably approximately 3 mm to 7 mm in length. In this embodiment, a cavity 46 within the filter 14 is defined at least in part by an inner periphery of a cylindrical tubular filter segment 48, and by the space between the mouthpiece filter segment 22 and the restrictor disc 26. A ventilation zone 40 is provided at a location along the cavity, which location is preferably downstream of the flow restriction 30 and spaced upstream from the mouthpiece segment 22. The tubular filter segment 48 is preferably constructed from a relatively heavy filter plug wrap, a paper or other material, such as cellulose acetate.

In this embodiment, the ventilation zone 40 comprises a plurality of ventilation holes 41 which extend through the tipping paper 16 and preferably, through the tubular filter segment 48. Accordingly, the material of the filter segment 48 is preferably cellulosic so that it can be laser perforated via online laser perforation techniques (or other perforating techniques) to provide ventilation holes during the manufacture of the smoking article 10. In the alternative, the ventilation holes are established in only the tipping paper 16 (either by using pre-perforated tipping paper or on-line perforating techniques), and the tubular segment 48 is sufficiently air-permeable to establish communication between the vent holes 41 and the cavity 46. Preferably, other perforating techniques may also be used, such as mechanical (pin) perforation techniques and/or electrostatic techniques and the like.

Figure 4:
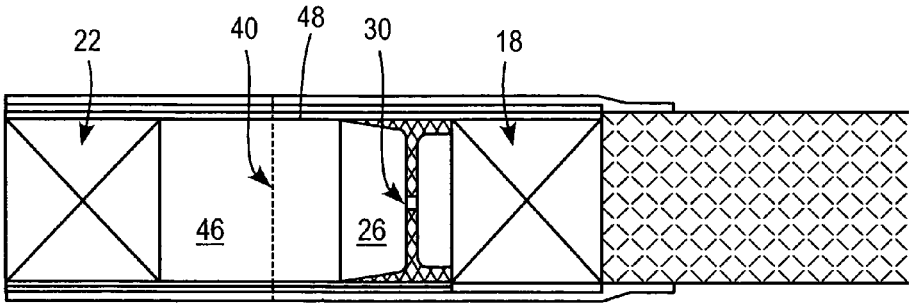
FIGS. 4 and 5 are side views of smoking articles with the tipping paper partially unwrapped to reveal filter components of further embodiments.

Referring to FIG. 4, another embodiment provides a smoking article comprising a tobacco rod, including the cut filler having a high glycerin content, and a filter connected with the tobacco rod by a tipping paper. Preferably, the filter comprises a first, upstream filter segment 18 constructed from cellulose acetate tow at an upstream portion of the filter, a mouthpiece filter segment 22 constructed from cellulose acetate tow at a downstream end portion of the filter, and a restrictor disc 26 situated between the first and mouthpiece filter segments 18 and 22, but preferably, adjacent the upstream segment 18. In this embodiment, the cavity 46 within the filter is defined at least in part by a preferably spiral wound paper tube 48 that extends the whole length of the filter and is sufficiently strong to be self-sustaining, yet thin enough to accommodate on-line laser perforation. The outer annulus of the restrictor disc preferably has a sliding fit with the inner surface of paper tube 48. In this embodiment, a cavity 46 within the filter 14 is defined at least in part by an inner surface of the cylindrical tubular filter segment 48, and by the space between the mouthpiece filter segment 22 and the restrictor disc 26. A ventilation zone 40 is provided at a location along the cavity, which location is preferably downstream of the flow restriction 30 and spaced apart from the mouthpiece segment 22. The tube 48 can be made using other materials or other forming techniques such as extruding the tube or forming a tube with a longitudinal seam.

Figure 5:
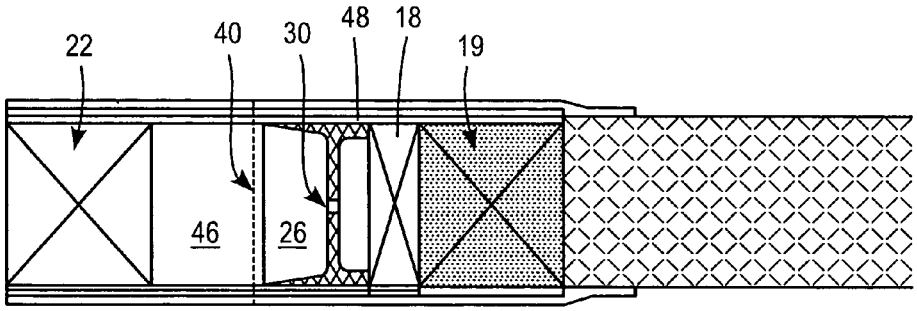

Referring to FIG. 5, another embodiment provides a smoking article comprising a tobacco rod including a cut filler having a high glycerin content, and a filter connected with the tobacco rod by a tipping paper. Preferably, the filter comprises a first filter segment 19 constructed from carbon on tow at an upstream portion of the filter, a second filter segment 18 constructed from cellulose acetate tow downstream of the first filter segment 19, a mouthpiece filter segment 22 constructed from cellulose acetate tow at a downstream end portion of the filter, and a restrictor disc 26 situated between the second and mouthpiece filter segments 18 and 22. In this embodiment, the outer annulus of restrictor disc 26 is preferably slightly frustoconical to facilitate plunging of restrictor disc 26 along tube 48 from left to right. In this embodiment, a cavity 46 within the filter 14 is defined at least in part by an inner surface of the cylindrical tubular filter segment 48, and by the space between the mouthpiece filter segment 22 and the restrictor disc 26. A ventilation zone 40 is provided at a location along the cavity, which location is preferably downstream of the flow restriction 30 and spaced apart from the mouthpiece segment 22.

Figure 6:
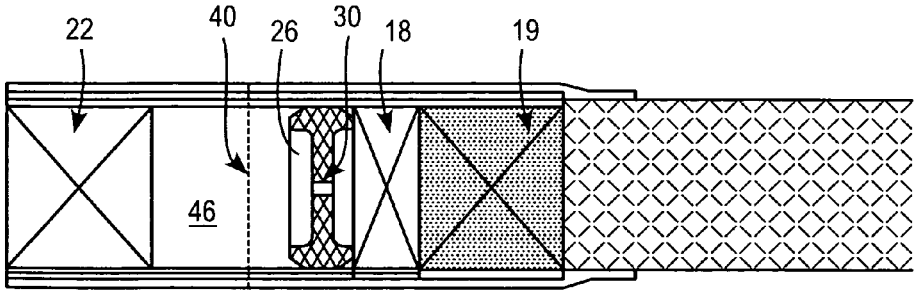
FIG. 6 is a side view a smoking article with the tipping paper partially unwrapped to reveal filter components including a flow restricting filter segment having end-to-end symmetry.

Referring to FIG. 6, another embodiment provides a smoking article comprising a tobacco rod including a cut filler having a high glycerin content, and a filter connected with the tobacco rod by a tipping paper. Preferably, the filter comprises a first filter segment 19 constructed from carbon on tow at an upstream portion of the filter, a second filter segment 18 constructed from cellulose acetate tow downstream of the first filter segment 19, a mouthpiece filter segment 22 constructed from cellulose acetate tow at a downstream end portion of the filter, and a flow restricting filter comprising a restrictor disc 26 having a flow restriction orifice 30 situated between the second filter segment 18 and the mouthpiece filter segment 22. In this embodiment, restrictor disc 26 preferably is symmetrical or has end-to end symmetry. In this embodiment, a cavity 46 within the filter 14 is defined at least in part by an inner surface of the cylindrical tubular filter segment 48, and by the space between the mouthpiece filter segment 22 and the restrictor disc 26. A ventilation zone 40 is provided at a location along the cavity, which location is preferably downstream of the flow restriction 30 and spaced apart from the mouthpiece segment 22.

Figure 7:
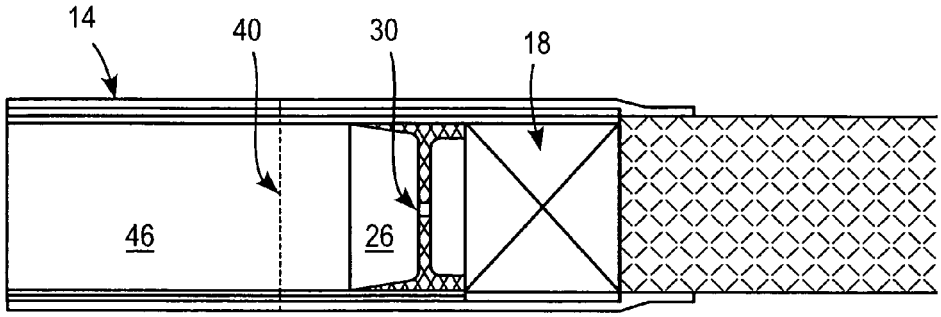
FIGS. 7 and 8 are side views of smoking articles with the tipping paper partially unwrapped to reveal filter components of further embodiments.

Referring to FIG. 7, another embodiment provides a smoking article comprising a tobacco rod and a filter connected with the tobacco rod by a tipping paper. Preferably, the filter 14 comprises a segment 18 of filter tow material at an upstream portion of the filter 14 and a flow restricting filter segment comprising a restrictor disc 26 having a flow restriction orifice 30 situated downstream of the filter segment 18. In this embodiment, a cavity 46 within the filter 14 is defined at least in part by an inner surface of the cylindrical tubular filter segment 48, and by the space between the mouthpiece filter segment 22 and the restrictor disc 26. A ventilation zone 40 is provided at a location along the cavity, which location is preferably downstream of the flow restriction 30 and spaced apart from the mouthend of the filter.

Figure 8:
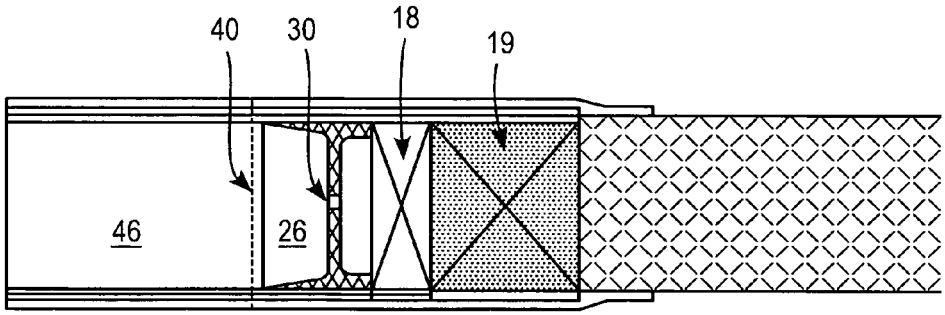

Referring to FIG. 8, another embodiment provides a smoking article comprising a tobacco rod and a filter connected with the tobacco rod by a tipping paper. Preferably, the filter comprises a first filter segment 19 constructed from carbon on tow at an upstream portion of the filter, a second filter segment 18 constructed from cellulose acetate tow downstream of the first filter segment 19, and a flow restricting filter comprising a restrictor disc 26 having a flow restriction orifice 30 situated downstream of the second filter segment 18. In this embodiment, a cavity 46 within the filter 14 is defined at least in part by an inner surface of the cylindrical tubular filter segment 48, and by the space between the mouthpiece filter segment 22 and the restrictor disc 26. A ventilation zone 40 is provided at a location along the cavity, which location is preferably downstream of the flow restriction 30 and spaced apart from the mouthend of the filter.

Preferred dimensions for an exemplary 83 mm smoking article include, for example, a filter length of approximately 27 mm, a mouth end filter segment length of approximately 7 mm, vent holes that are located approximately 12 mm from the mouth end of the smoking article, a restrictor disc length of approximately 5 mm, a cellulose acetate tow segment length of approximately 2.5 mm, and a carbon on tow filter segment length of approximately 7 mm.

The ventilation zone 40 is established with a first row (and optionally second and possibly third rows) of ventilation holes through the tipping paper 16 and preferably through filter tube 48'. Accordingly, air is preferably drawn through the ventilation holes of ventilation zone 40 and into the cavity 46 defined between the flow restriction 30 and the mouthpiece filter segment 22.

Preferably the ventilation zone 40 is located near or adjacent to the flow restriction 30 so that air drawn through the ventilation zone 40 is allowed to mix with the mainstream smoke before arriving at the mouthpiece filter 22. Preferably, the distance between the ventilation zone 40 and the mouthpiece filter 22 is at least 5 mm or in the range of 5-12 mm. Also preferably, the flow restriction 30 is spaced approximately 4 mm to 15 mm from the mouthpiece filter 22, more preferably approximately 6 to 10 mm. These features help minimize impaction of the particulate phase smoke constituencies at the mouthpiece filter 22, which in turn, helps maintain the desired CO to tar (FTC) ratios.

Preferably, the ventilation zone 40 achieves a ventilation level of the smoking article of at least 25% and more preferably at least 50% to 90%.

Furthermore, the embodiments provide a desired amount of resistance to draw while maintaining the desired degree of high ventilation throughout the puff count. The latter attribute is achieved by placement of the ventilation zone 40 downstream of the flow restriction 26. Furthermore, placing the ventilation along the cavity assures mixing of air drawn into the filter through the ventilation zone with mainstream smoke drawn from the tobacco rod.

The restrictor disc 26 may comprise a partition (transverse wall having one or more orifices therein) that establishes the flow restriction 30, with the partition including an orifice of reduced diameter. The partition may be frustoconical and convergent either into or away from the direction of flow of mainstream smoke passing therethrough. Furthermore, a pair of partitions may be arranged internally within the restrictor disc 26 so as to provide end to end symmetry for the restrictor disc 26. A filter component having end to end symmetry facilitates high speed filter rod making in that the component works the same whether or not the rod making machine orients one end of the component first or reverses it.

A restrictor disc 26 having end to end symmetry has tubular body portions of equal length on opposite sides of a transverse wall (partition). By such arrangement manufacture of the filter is facilitated by the end to end symmetry of the restrictor disc 26.

Optionally, a second zone of ventilation may be located upstream of the flow restriction 30 in addition to the ventilation zone 40 as provided above.

Manufacture of the smoking articles 10 described above is facilitated with the use of pre-perforated tipping paper.

Preferably the flow restriction 30 is sized to contribute sufficient pressure drop such that the smoking article 10 presents a resistance to draw of at least 70 mm water or greater, preferably in the range of 90-120 mm water. In an embodiment, the flow restriction 30 is sized to contribute sufficient pressure drop such that the smoking article 10 presents a resistance to draw of at least 50 mm water or greater, preferably in the range of 60-90 mm water. Preferably, the partition (transverse wall) has a diameter of approximately 7.0 to 8.0 mm and more preferably approximately 7.4 to 7.8 mm wherein the partition preferably has one or optionally, at least one orifice of a diameter of about 0.5 mm to about 0.9 mm and more preferably about 0.5 to 0.7 mm. Since the pressure drop of the restrictor component depends on the open area, multiple orifices can also be used. For example, in one embodiment there are two orifices in the partition of approximately 0.5 mm diameter each.

The restrictor disc 26 may be constructed of paper, a plastic, polymer or a metal and more preferably made of a paper product or a biodegradable plastic/polymer or other suitable material having degradability properties. However, in the case of plastic being used, the restrictor disc 26 is small and the non-biodegradable content of the filter is minimized.

An advantage of the filter designs described above is that the filter may be constructed from simple combining techniques typically used in the industry for manufacturing cigarettes at high speeds. Additionally each embodiment includes tubular support about the cavity 46 so as to provide desired firmness throughout the length of the filter 14.

Furthermore, the embodiments provide the necessary amount of resistance to draw while maintaining the desired degree of high ventilation throughout the smoke. The latter attribute is achieved by placement of the ventilation zone 40 downstream of the flow restriction 30.

Furthermore, placing the ventilation in ventilation zone 40 in spaced apart relation to the mouthpiece filter plug 22 assures mixing of air drawn into the filter 14 through the ventilation zone 40 with mainstream smoke drawn from the tobacco rod 12. In one tested embodiment, uniform stain patterns appeared at the buccal end of the mouthpiece filter 22, which is indicative of good mixing.

During smoking of a cigarette constructed in accordance with the present disclosure, a desired degree of ventilation (e.g., 50 to 90%, preferably about 60% or about 70%) is preferably maintained throughout the smoke.

Addressing Phenolics in Mainstream Smoke

Cellulose acetate filters (CA) with triacetin as plasticizer are known to remove phenol and cresols from mainstream cigarette smoke when compared to non-filter cigarettes on an equal tar basis. The present restrictor filter design reduces the amount of such CA in a filter by about 50% (e.g., conventional cigarette with a 27 mm filter versus an equivalent restrictor filter with 10 mm to 14 mm of such CA segments). The reduction of CA results in an apparent increase in levels of phenols per unit tar (FTC) and cresols per unit tar (FTC) compared to conventional CA filters, although the phenol/tar and cresols/tar ratios in the restrictor filter design are still lower than that of non-filter cigarettes on an equal tar basis. To counteract that effect, an aerosol former such as glycerin is added to tobacco cut filler to compensate for and decrease the cresols/tar and the phenols/tar ratios, i.e. the addition of glycerin serves to counteract the relative increase of phenol/tar and cresols/tar ratios in smoking articles containing lesser amounts of plasticized CA.

Beyond expected reduction due to dilution standing alone, glycerin has an additional effect on phenol and polyphenolics (which include catechol and hydroquinone), which is believed to be a tendency for glycerin in the tobacco rod to reduce the levels of these compounds by some chemical and/or physical mechanism. Glycerin is an agent that is both a tar diluent and an agent that mechanistically further reduces particulate phase smoke constituents such as hydroquinone and catechol by its presence in a tobacco rod. The restrictor/glycerin combination can be applied to any delivery level or "tar category" (FTC tar) and at any desired level of tar diluent.

Preferably, the addition of glycerin in a tobacco rod is at a level sufficient to counteract the tendency of phenols to pass through low particulate efficiency CA filter segments at a greater rate than they do with conventional CA filters.

Table 2 discloses the tar content, both under FTC conditions and the more stringent Massachusetts test, of a smoking article of a preferred embodiment including 7% glycerin in cut filler and a filter including cellulose acetate upstream an downstream filter segments, a flow restrictor therebetween, and a cavity downstream of the flow restrictor in communication with a ventilation zone. FTC smoking conditions include 35 ml puffs of 2 second duration every 60 seconds. Massachusetts smoking conditions include 45 cc puffs of 2 second duration every 30 seconds, with 50% of the ventilation blocked.

TABLE 2

Restrictor Cigarette Test Results

| | FTC | Massachusetts |
|---|---|---|
| Tar | 6.9 mg/cigarette | 21.4 mg/cigarette |
| Puff Count | 9.0 | 13.1 |
| CO | 3.7 mg/cigarette | 12.1 mg/cigarette |
| Tar/Puff | 0.8 mg/puff | 1.6 mg/puff |
| CO/Puff | 0.4 mg/puff | 0.9 mg/puff |
| CO/Tar | 0.5 | 0.6 |

From the above, it is noteworthy that CO/tar values remained low.

Cigarettes of certain embodiments may yield less than about 0.9, often less than about 0.5, and usually between about 0.05 and about 0.3 FTC "tar" per puff on average when smoked under FTC smoking conditions. Such cigarettes are "ultra low tar" cigarettes which yield less than about 7 mg FTC "tar" per cigarette. Typically, such cigarettes yield less than about 9 puffs, and often about 6 to about 8 puffs, when smoked under FTC smoking conditions.

Figure 9:
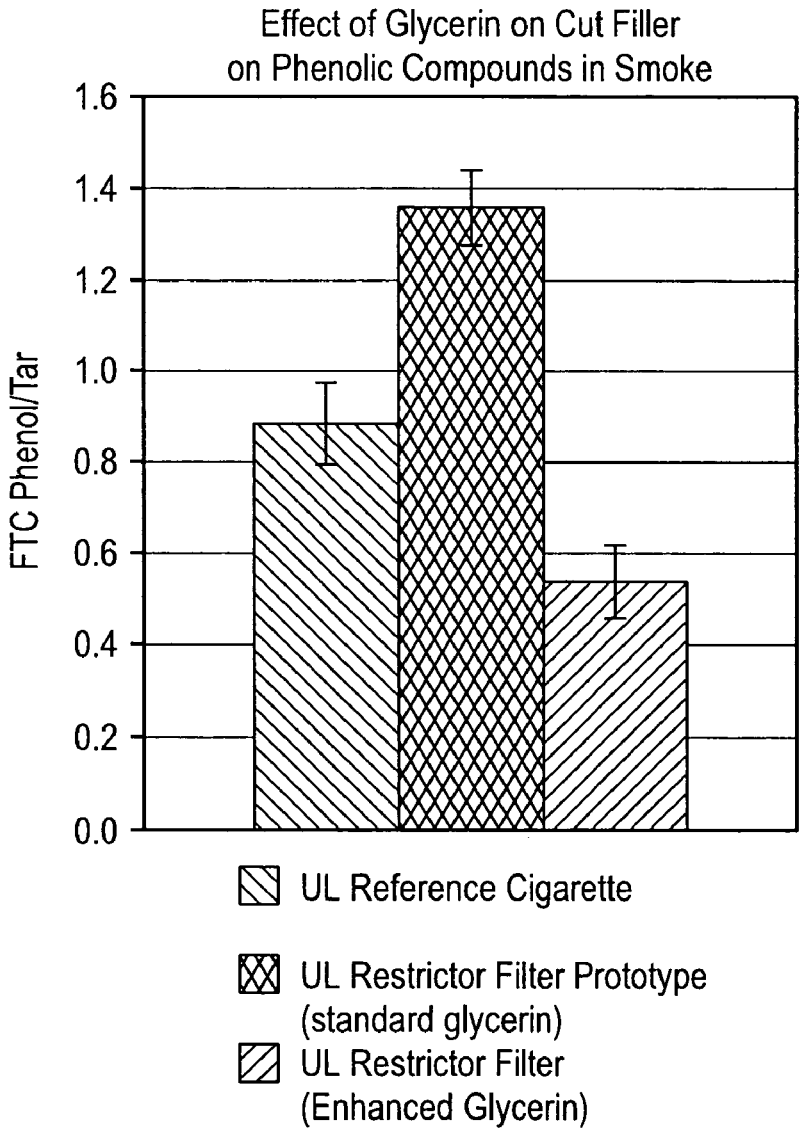
FIG. 9 is a graph illustrating the effect of glycerin on cut filler and restrictor filters on phenol in smoke.

Referring now to FIG. 9, the effect of glycerin applied to cut filler on phenolic compounds in mainstream smoke is shown. Ultra low tar cigarettes including about 2% glycerin and no restrictor have about 0.9 μg phenol per mg tar FTC. Ultra low tar restrictor filter cigarettes including a restrictor and about 2% glycerin have about 1.35 μg phenol per mg tar FTC. In contrast, ultra low tar cigarettes including both a restrictor, an enhanced glycerin content of about 7%, and an upstream cellulose acetate filter plug have about 0.55 μg phenol per mg tar FTC.

Figure 10:
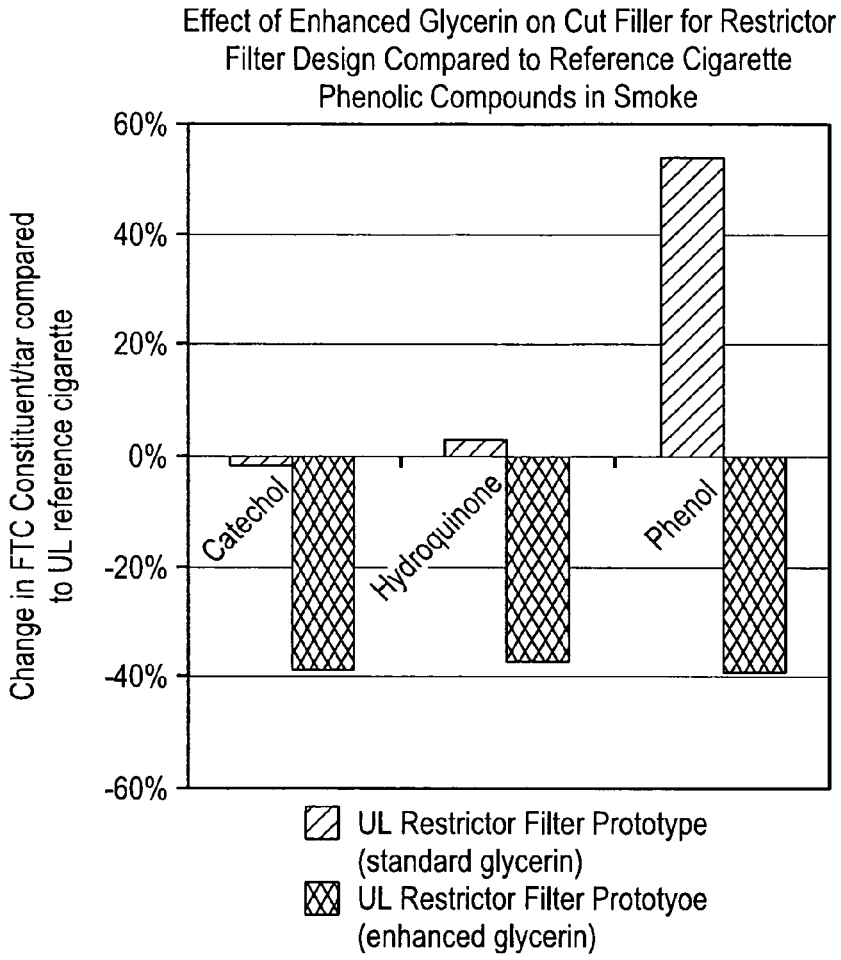
FIG. 10 is a graph illustrating the effect of enhanced glycerin level in cut filler for a restrictor filter design compared to a reference cigarette containing a restrictor and a 2% level of glycerin on cut filler.

FIG. 10 compares the effect cigarettes containing a filter including a restrictor and an upstream cellulose acetate filter plug and cut filler including about 7% glycerin to cigarettes containing a filter including a restrictor and low levels of glycerin (about 2%). These effects were represented relative to phenolic levels of a conventional, commercial ultra low delivery cigarette. Cigarettes including the restrictor and enhanced glycerin showed a nearly 40% decrease in the amount of phenol, an approximately 39% decrease in catechol, and an approximately 37% decrease in the amount of hydroquinone in mainstream smoke. In contrast, cigarettes containing a restrictor and about 2% glycerin showed a minor drop in catechol, a minor rise in hydroquinone, and a nearly 55% rise in phenol in mainstream smoke.

Figure 11:
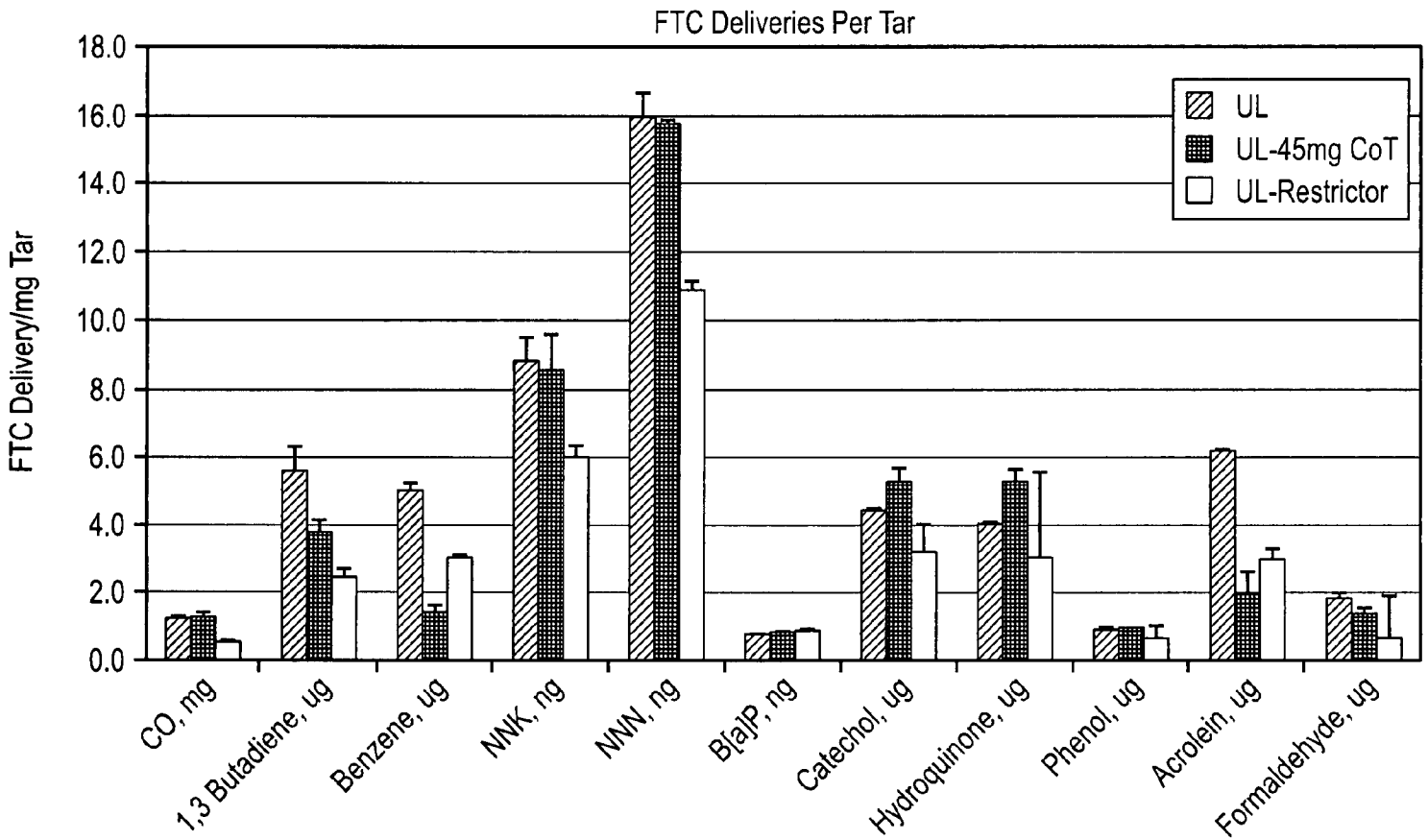
FIG. 11 is a graph illustrating the effect of enhanced glycerin level in cut filler for a restrictor filter design on FTC deliveries per tar as compared to commercially available ultra low delivery smoking articles and commercially available ultra low delivery smoking articles including carbon on tow.

Referring now to FIG. 11, a graph illustrates the effect of enhanced glycerin (about 7%) in cut filler in combination with a filter including a ventilation level of approximately 70%, a restrictor and an upstream cellulose acetate filter plug on FTC deliveries per tar. As shown, the FTC delivery/mg Tar of CO, 1,3-butadiene, NNK, NNN, catechol, hydroquinone, phenol, and formaldehyde is reduced when compared to commercially available ultra low tar delivery smoking articles containing about 2% glycerin and commercially available ultra low tar (FTC) delivery smoking articles including carbon on tow and about 2% glycerin.

It is noteworthy that highly ventilated restrictor cigarettes with 7% glycerin achieved smoke constituent reductions the same or better that 45 mg activate carbon. The filter achieves the smoke constituent reduction desired by carbon-filter cigarettes without the taste penalty associated with carbon-filters.

Figure 12:
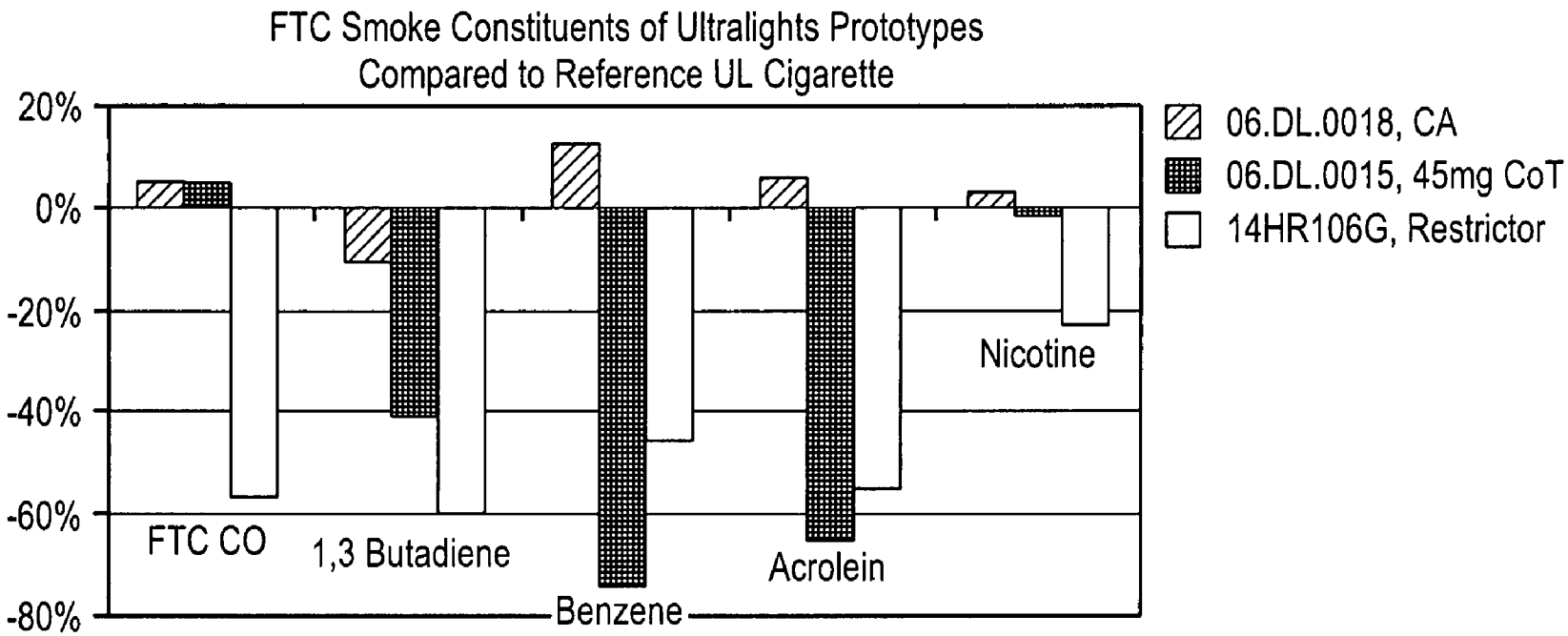
FIG. 12 is a graph illustrating the reductions of FTC smoke constituents of smoking articles.

FIG. 12 is a graph illustrating the FTC smoke constituents of a preferred embodiment ultra low tar cigarette including a restrictor and 7% glycerin as compared to an ultra low tar cigarette including 2% glycerin and an ultra low tar cigarette including 45 mg carbon on tow and 2% glycerin. As shown, the cigarette constructed according to a preferred embodiment showed significant reductions in CO, nicotine, and 1,3-butadiene.

In addition, Table 3 shows the effect of the restrictor filter design including an upstream cellulose acetate plug and enhanced glycerin levels (about 7%) on gas phase constituents of mainstream cigarette smoke with and without activated carbon included in the filter.

TABLE 3

| | Absence of Activated Carbon in the Filter | Activated Carbon Paper in the Filter, including 25 to 30 mg carbon (upstream from filter vent holes) | Activated Carbon on Tow in the Filter, including 25 to 30 mg carbon (upstream from filter vent holes) |
|---|---|---|---|
| CO | Average: −59% STD: 3% | Average: −59% STD: 3% | Average: −59% STD: 3% |
| NO | Average: −50% STD: 5% | Average: −50% STD: 5% | Average: −50% STD: 5% |
| VOC (1.3, butadiene, acrilonitrile, benzene, isoprene, toluene) | Average: −47% STD: 8% | Average: −72% STD: 4% | Average: −71% STD: 2% |
| Carbonyls | Average: −47% STD: 7% | Average: −75% STD: 4% | Average: −71% STD: 7% |
| Gas Vapor Phase (GVP) Index (CO, NO, VOC, carbonyls) | −51% | −64% | −63% |

(STD—standard deviation)

By including carbon, either on paper or on CA tow, upstream of the ventilation holes the presence of VOC, carbonyls, and the gas vapor phase were reduced beyond cigarettes containing no activated carbon in addition to the restrictor and 7% glycerin levels.

Table 4 discloses the concentration of particulate phase constituents of a smoking article of a preferred embodiment including 7% glycerin in cut filler and a filter including cellulose acetate upstream an downstream filter segments, a flow restrictor therebetween, and a cavity downstream of the flow restrictor in communication with a ventilation zone as compared smoking articles including a standard amount of glycerin, about 2%, and a filter including cellulose acetate upstream an downstream filter segments, a flow restrictor therebetween, and a cavity downstream of the flow restrictor in communication with a ventilation zone.

TABLE 4

| | Low FTC Tar Restrictor Prototype with 7% Glycerin in the Cut Tobacco | | | | Low FTC Tar Restrictor Prototype with Standard Glycerin in the Cut Tobacco | | | |
|---|---|---|---|---|---|---|---|---|
| | | | Compared to Low FTC Tar Commercial Cigarette | | | | Compared to Low FTC Tar Commercial Cigarette | |
| | AVG | Stdev | per CIGARETTE | per TAR | AVG | Stdev | per CIGARETTE | per TAR |
| *FTC Tar (Linear), mg/cigt. | 5.5 | 0.3 | −10% | | 6.9 | 0.2 | 16% | |
| *FTC Nic. (Linear), mg/cigt. | 0.42 | 0.02 | −21% | −12% | 0.65 | 0.02 | 28% | 10% |
| *FTC Puffs/cigt.(Linear) | 9.3 | 0.3 | 21% | | 9.0 | 0.2 | 15% | |
| *FTC CO (Linear) mg/cigt. | 2.6 | 0.2 | −65% | −61% | 3.7 | 0.1 | −49% | −56% |
| *1,3-Butadiene FTC, ug/cigt. | 11.4 | 0.3 | −62% | −58% | 18.2 | 1.3 | −45% | −55% |
| *Acrylonitrile FTC, ug/cigt. | 2.3 | 0.02 | −61% | −57% | 3.8 | 0.1 | −30% | −43% |
| *Benzene FTC, ug/cigt. | 16 | 0.2 | −47% | −42% | 20.2 | 0.8 | −32% | −45% |
| *Isoprene FTC, ug/cigt. | 112 | 3 | −59% | −55% | 163 | 7 | −42% | −53% |
| *Toluene FTC, ug/cigt. | 26 | 0.42 | −44% | −39% | 34.7 | 1.2 | −25% | −39% |
| Total TSNA, ng/cigt. | 180 | 8 | −19% | −11% | 275 | 12 | 12% | −9% |
| *B[a]A FTC, ng/cigt. | 8.4 | 0.2 | 4% | 15% | 11.5 | 0.6 | 42% | 16% |
| *B[a]P FTC, ng/cigt. | 4.5 | 0.1 | −4% | 6% | 6.0 | 0.4 | 36% | 11% |
| *Catechol FTC, ug/cigt. | 18.5 | 0.1 | −26% | −17% | 31.8 | 1.3 | 20% | −2% |
| *Hydroquinone FTC, ug/cigt. | 17.9 | 0.1 | −27% | −18% | 30.5 | 1.4 | 26% | 3% |
| *Phenol FTC, ug/cigt. | 3.8 | 0.0 | −30% | −21% | 9.9 | 0.4 | 89% | 54% |
| *Acetaldehyde FTC, ug/cigt. | 168 | 16.4 | −59% | −54% | 235 | 35 | −41% | −58% |

TABLE 4-continued

| | Low FTC Tar Restrictor Prototype with 7% Glycerin in the Cut Tobacco | | | | Low FTC Tar Restrictor Prototype with Standard Glycerin in the Cut Tobacco | | | |
|---|---|---|---|---|---|---|---|---|
| | | | Compared to Low FTC Tar Commercial Cigarette | | | | Compared to Low FTC Tar Commercial Cigarette | |
| | AVG | Stdev | per CIGARETTE | per TAR | AVG | Stdev | per CIGARETTE | per TAR |
| *Acrolein FTC, ug/cigt. | 15 | 1.8 | −63% | −58% | 21 | 4 | −43% | −59% |
| *Butyraldehyde FTC, ug/cigt. | 12 | 1.1608 | −49% | −42% | 18 | 2 | −22% | −44% |
| *Crotonaldehyde FTC, ug/cigt. | 3 | 0.467 | −68% | −64% | 7 | 2 | −8% | −34% |
| *Methyl Ethyl Ketone, ug/cigt. | 21 | 2.1665 | −53% | −47% | 33 | 5 | −21% | −43% |
| *Propionaldehyde FTC, ug/cigt. | 14 | 1.2414 | −55% | −49% | 19 | 3 | −36% | −55% |
| Glycerin in Smoke, mg/cigt. | 1.19 | 0.05 | | | 0.46 | 0.03 | | |
| *Total RTD, mm of H2O | 81 | 3 | | | 80.0 | 3.0 | | |
| *Filter RTD, mm of H2O | 388 | 52 | | | 446 | 24 | | |
| *Ventilation, % | 73 | 1 | | | 68 | 1 | | |

As shown in Table 4, the concentration of particulate phase constituents of a smoking article of a preferred embodiment including 7% glycerin in cut filler is reduced as compared to the commercially available low FTC Tar smoking articles including a standard amount (2%).

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

We claim:

1. A smoking article comprising:

a tobacco rod including a smokeable material including a phenol control agent, the phenol control agent being operative as a tar diluent and as a mechanism to reduce phenol levels in mainstream smoke; and a filter attached to the tobacco rod by tipping paper, the filter having an upstream end adjacent the tobacco rod, a filter plug of low filtration efficiency cellulose acetate at a downstream end thereof, a restrictor defining at least one flow passage therethrough upstream of the filter plug, an empty cavity extending between an upstream end of the filter plug and a downstream end of the restrictor, and a ventilation zone extending through the tipping paper and communicating with the cavity, the restrictor providing a resistance to draw of at least 70 mm water and the ventilation zone providing at least 60% dilution to the mainstream smoke, wherein the phenol control agent comprises glycerin present in the tobacco rod in an amount of at least 4% by weight of the smoking material in the tobacco rod.

2. The smoking article of claim 1, wherein said filter further includes a cylindrical tube attached to said tobacco rod with tipping paper and a first filter segment at a location along said cylindrical tube adjacent and in a downstream relation to said tobacco rod.

3. The smoking article of claim 1, wherein glycerin is present in an amount of about 5% to about 15%.

4. The smoking article of claim 1, wherein said smokeable material further includes an acetate compound selected from the group consisting of ammonium acetate, calcium acetate, magnesium acetate, and combinations thereof.

5. The smoking article of claim 1, wherein said smokeable material includes a shredded reconstituted tobacco sheet, said phenol control agent being a component of said reconstituted tobacco sheet.

6. The smoking article of claim 5, wherein said reconstituted tobacco sheet is included in said smokeable material in an amount of about 10% to about 80% by weight of the smokeable material or wherein said reconstituted tobacco sheet is included in said smokeable material in an amount of about 30% to about 50% by weight of the smokeable material.

7. The smoking article of claim 1, wherein said restrictor consists of a tubular segment having a single transverse wall with one or more orifices therein and wherein said transverse wall is centrally located between upstream and downstream ends of the tubular segment.

8. The smoking article of claim 1, wherein said filter includes a single restrictor having a plurality of orifices, wherein each of the plurality of orifices has a diameter of about 0.2 mm to about 0.6 mm.

9. The smoking article of claim 1, further including a sorbent containing filter segment upstream of said restrictor.

10. The smoking article of claim 1, wherein said restrictor comprises beveled edges at upstream and downstream ends thereof.

11. The smoking article of claim 1, wherein said filter includes a single restrictor having a frustoconical transverse wall, which is convergent downstream or upstream.

12. The smoking article of claim 1, wherein said filter includes a single restrictor consisting of a restrictor disc of approximately 5 mm or less in length.

13. A method of treating mainstream smoke comprising:

drawing mainstream smoke from a tobacco rod through a restrictor while communicating a ventilation zone with said mainstream smoke downstream of said restrictor; and during said drawing step, diluting said mainstream smoke with a glycerin aerosol component, wherein glycerin is present in the tobacco rod in an amount of at least 4% by weight of smoking material in the tobacco rod.

* * * * *